US005335728A

United States Patent [19]

Strahan

[11] Patent Number: 5,335,728

[45] Date of Patent: Aug. 9, 1994

[54] METHOD AND APPARATUS FOR DISPOSING OF WATER AT GAS WELLS

[76] Inventor: Ronald L. Strahan, 2416 Apple Way, Edmond, Okla. 73013

[21] Appl. No.: 923,699

[22] Filed: Jul. 31, 1992

[51] Int. Cl.[5] ..... E21B 43/34; E21B 36/00

[52] U.S. Cl. ..... 166/267; 166/53; 166/57; 166/302

[58] Field of Search ..... 166/267, 302, 369, 53, 166/57, 62

[56] References Cited

U.S. PATENT DOCUMENTS

| | | | |
|---|---|---|---|
| 2,497,868 | 2/1950 | Dalin . | |
| 2,588,296 | 3/1952 | Russell, Jr. . | |
| 3,057,758 | 10/1962 | Walker et al. . | |
| 3,237,689 | 3/1966 | Justheim . | |
| 3,493,050 | 2/1970 | Kelley et al. | 166/267 |
| 3,598,182 | 8/1971 | Justheim | 166/247 |
| 3,780,805 | 12/1973 | Green | 166/267 X |
| 3,989,415 | 11/1976 | Van-Hee et al. | 417/312 |
| 4,025,235 | 5/1977 | Newbrough | 417/54 |
| 4,087,208 | 5/1978 | Uda et al. | 417/54 |
| 4,159,036 | 6/1979 | Wilson et al. | 166/267 |
| 4,349,228 | 9/1982 | Rohde | 299/10 |
| 4,366,063 | 12/1982 | O'Connor | 210/652 |
| 4,395,338 | 7/1983 | Rowton | 210/747 |
| 4,442,898 | 4/1984 | Wyatt | 166/303 |
| 4,463,803 | 8/1984 | Wyatt | 166/59 |
| 4,509,599 | 4/1985 | Chenoweth et al. | 166/370 |
| 4,531,584 | 7/1985 | Ward | 166/265 |
| 4,536,293 | 8/1985 | Babineaux, III | 210/717 |
| 4,573,911 | 3/1986 | Kimmich | 166/302 X |
| 4,597,437 | 7/1986 | McNabb | 166/79 |
| 4,613,338 | 9/1986 | Rogers et al. | 23/301 |
| 4,661,127 | 4/1987 | Huntley | 55/174 |
| 4,779,677 | 10/1988 | Cobb | 166/79 |
| 4,804,477 | 2/1989 | Allen et al. | 210/737 |
| 4,882,009 | 11/1989 | Santoleri et al. | 159/4.2 |
| 4,930,574 | 6/1990 | Jäger et al. | 166/266 |
| 4,995,460 | 2/1991 | Strahan | 166/267 |
| 5,002,657 | 3/1991 | Botts | 210/115 |

FOREIGN PATENT DOCUMENTS 985640 3/1965 United Kingdom .

*Primary Examiner*—George A. Suchfield
*Attorney, Agent, or Firm*—Dunlap, Codding & Lee

[57] ABSTRACT

A method and apparatus for disposing of water at gas wells. Water from the water holding tank is collected periodically in a heating vessel. Hot fluid from an auxiliary engine system, such as the oil pump or the water pump for the compressor engine, is pumped through a heat conductive coil around the heating vessel to heat the well water in the heating vessel. The heated well water then is injected into the hot exhaust line from the compressor either between the compressor and the muffler or alternatively is injected directly into the muffler. The heating vessel is pressurized with gas from the well to assist in the evacuation of the heated water from the heating vessel and the injection of the well water into the hot exhaust. A system of valves controls the delivery of water to the heating vessel, ensures that the heating vessel will not be over pressurized and deactivates the apparatus when the gas compressor is not running.

54 Claims, 1 Drawing Sheet

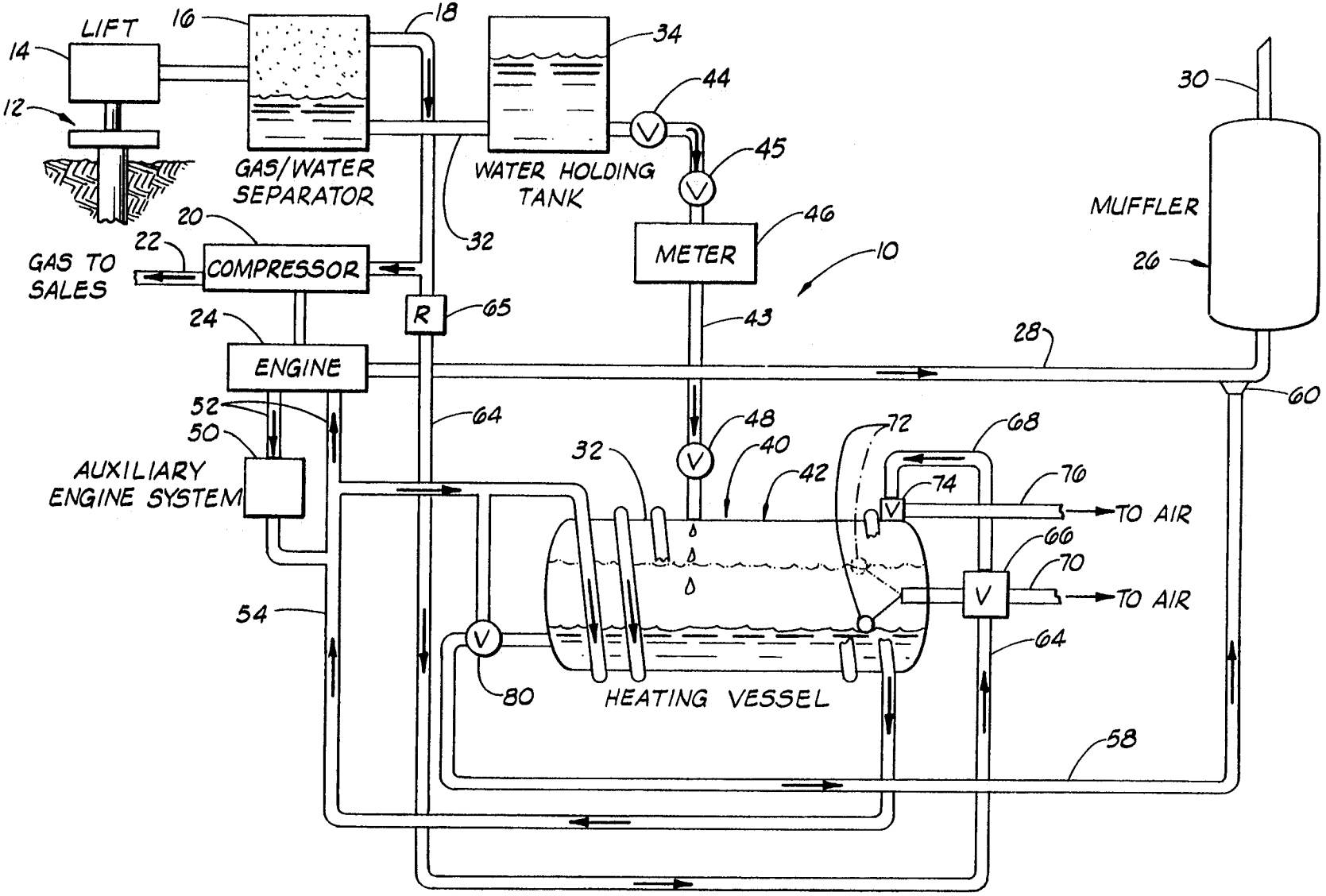
MUFFLER
TO AIR
TO AIR
METER
WATER HOLDING TANK
HEATING VESSEL
GAS/WATER SEPARATOR
COMPRESSOR
ENGINE
LIFT
GAS TO SALES
AUXILIARY ENGINE SYSTEM
R
V
10
12
14
16
18
20
22
24
26
28
30
32
34
40
42
43
44
45
46
48
50
52
54
58
60
64
65
66
68
70
72
74
76
80

METHOD AND APPARATUS FOR DISPOSING OF WATER AT GAS WELLS

FIELD OF THE INVENTION

The present invention relates generally to water disposal systems and particularly to methods and apparatuses for disposing of water produced by a gas well.

SUMMARY OF THE INVENTION

The present invention comprises a method for disposing of water produced by a gas well assembly comprising a gas compressor including an engine producing hot exhaust and an auxiliary engine system which circulates a hot fluid. The method comprises receiving water from the well in a heating vessel and contacting the water in the heating vessel with the hot fluid in the auxiliary engine system under conditions which permit heat in the auxiliary engine system fluid to be transferred to the well water in the heating vessel. The heated water is evacuated from the heating vessel and injected into the hot exhaust from the gas compressor engine whereby the water is vaporized.

The present invention further comprises an apparatus for disposing of water produced at a gas well assembly which includes a gas compressor driven by an engine which produces hot exhaust and which includes an auxiliary engine system comprising a hot fluid in circulation. The apparatus comprises a heating vessel for containing water from the well under conditions whereby the water is heated and means for circulating the hot fluid in the auxiliary engine system under heat exchange conditions around the heating vessel whereby water in the heating vessel is heated. Means is included in the apparatus for evacuating the heated water from the heating vessel and for injecting the heated water into the hot exhaust from the gas compressor engine whereby the water is vaporized.

Still further, the present invention comprises a gas well assembly including a gas well, a gas/water separator and a conduit for conducting the product of the gas well to the gas/water separator. The assembly includes a gas compressor for compressing gas produced by the well. The compressor has an engine which produces hot exhaust and an auxiliary engine system which circulates hot fluid. A conduit conducts gas from the gas/water separator to the gas compressor. The assembly further comprises a heating vessel for containing and heating water from the gas well and means for contacting the hot fluid in the auxiliary engine system with the water in the heating vessel under conditions which permit the heat from the hot fluid to be transferred to the water in the heating vessel. A conduit of some sort is provided for evacuating heated water from the heating vessel and for injecting the heated water into the hot exhaust from the gas compressor engine whereby the water is vaporized.

BRIEF DESCRIPTION OF THE DRAWING

The single figure is a schematic drawing of a water evaporation system for disposing of water at a gas well constructed in accordance with the present invention.

DETAILED DESCRIPTION OF THE PREFERRED EMBODIMENT

Most gas wells produce quantities of salt water along with the gas. Because of the salt content, the water cannot be drained off onto the surrounding terrain as it would kill the vegetation and harm animals. Consequently, the proper disposal of the salt water is essential. In most instances the salt water must be collected and hauled to approved dump sites. This procedure is time consuming and very costly.

The present invention provides a convenient and inexpensive system for disposing of the water produced by gas wells at the well site. Equipment commonly in use at most gas wells can be modified easily and economically to function in accordance with the present invention.

With reference now to the figure, shown therein and designated by the reference numeral 10 is a typical gas well assembly modified in accordance with the present invention. The assembly 10 comprises a gas well 12. A lift mechanism 14 sometimes is used to lift the product of the well 12 to the surface and conduct it to a gas/water separator 16.

Most gas wells produce gas at a pressure lower than is required for introduction into a collecting pipeline by which the gas is distributed for sale. Accordingly, the gas from the gas/water separator 16 is carried by an output line 18 to a gas compressor 20. The gas compressor 20 compresses the gas to a pressure compatible with the collecting pipeline 22.

The gas compressor 20 is driven by an engine 24 of some sort. Most compressors used at gas wells are of the reciprocating type. However, other types of compressors, such as those driven by turbine engines, may be used in practicing the present invention. The only requirement for the compressor is that the engine driving the compressor be characterized by the discharge of hot exhaust.

As used herein, "hot" refers to a temperature high enough to vaporize water, or greater than 212 degrees Fahrenheit. The hot exhaust line from the engine of a typical gas compressor of the reciprocal type is about 500 degrees Fahrenheit to 700 degrees Fahrenheit, which is well above the minimum temperature required. Turbine compressors produce an exhaust as hot as 1000 degrees Fahrenheit.

The exhaust produced by compressors creates tremendous noise. To reduce the noise, a muffler 26 is utilized. A pipe 28 carries the hot exhaust from the compressor engine to the muffler 26. The hot exhaust escapes from the muffler 26 to the atmosphere through the vent pipe 30.

The water produced by the well 12 is conducted from the gas/water separator 16 by the conduit 32 to a holding tank 34. The size and construction of the holding tank 34 will vary depending on the volume of water being produced by the well 12. Preferably, the tank 34 is large enough to contain at least several times the average daily volume of water produced by the well 12.

In accordance with the present invention water from the water holding tank 34 next is channeled to an apparatus designated generally in the figure by the reference numeral 40 for heating and vaporizing the water. The apparatus 40 comprises a heating vessel 42 connected to the separator 34 by a conduit 43. The heating vessel 42 may be of any construction which permits the containment of water under pressure. However, 25 gallon tanks are commercially available and are ideal for this purpose.

Two valves 44 and 45, preferably ball valves, may be interposed in the conduit 43 for manually controlling the delivery of water from the water holding tank 34 to the heating vessel 42. A meter 46 of some sort also may be provided to monitor the volume of water being delivered to the heating vessel 42.

As will be described in more detail hereafter, the heating vessel 42 is pressurized. A check valve 48 preferably is installed in the conduit 43. The valve 48 closes if the pressure in the heating vessel 42 rises and prevents the entry of more water into the heating vessel.

The engines which drive gas compressors of the types used at gas wells typically comprise various subsystems including a water pump and an oil pump. Both of these subsystems involve the circulation of a fluid which becomes heated during the operation of the engine. For example, the water in a water pump system usually is maintained at about 180 degrees Fahrenheit. Similarly, the oil circulating in the oil pump system is maintained during operation of the compressor engine at about 250 degrees Fahrenheit. The engine subsystems which circulate such hot fluids are referred to herein generally as auxiliary engine systems.

An auxiliary engine system is indicated in the figure at 50. The hot fluid in the auxiliary engine system 50 is circulated in the engine 24 through a conduit 52.

The present invention makes use of the heat in the circulating fluid of the auxiliary engine system 50 by using this fluid to heat water in the heating vessel 42. To this end the apparatus 40 comprises a conduit 54 connected in line to the conduit 52. It will be understood that additional fluid will need to be added to the auxiliary engine system 50 initially to accommodate the added circulating volume. The conduit 54 is made of some heat conductive material, such as copper, and is configured to contact the surface of the heating vessel 42. In this way, the heat from the hot fluid in the auxiliary engine system 50 is transferred to the water in the heating vessel 42.

One suitable configuration includes a coil 56 which surrounds the heating vessel 42. In the figure a portion of the coil 56 has been cut away in order to illustrate the contents of the heating vessel 42. However, it will be appreciated that the coil 56 is one of several configurations which would be effective for this purpose.

The heated water in the heating vessel 42 is evacuated through a suitable conduit 58 and injected into the hot exhaust from the engine 24 whereby the water is vaporized almost instantly. This may be accomplished by connecting the conduit 58 into the hot exhaust conduit 28 from the engine 24. To improve the dispersal of the water as it is injected into the hot exhaust a suitable nozzle 60 may be employed which will spray the water in the hot exhaust. Alternately, the conduit 58 may be attached directly to the side wall of the muffler 28.

As indicated previously, the heating vessel 42 preferably is pressurized to assist in the evacuation of the water. In accordance with the present invention, the well gas may be utilized for this purpose. In this way, no additional fuel or pressurization equipment is necessary. To accomplish this, the apparatus 40 is provided with a conduit 64 which feeds gas from the well 12 and, more particularly, from the gas/water separator 16 into the heating vessel 42. It will be appreciated that gas from most gas wells is pressurized naturally to about 30–40 psi. This is sufficient to pressurize the heating vessel 42. A regulator 65 is installed into the conduit 64 near the compressor 20. The regulator 65 closes the conduit 64 if the pressure in the conduit exceeds a predetermined level, such as 30 psi.

To prevent over-pressurizing the heating vessel 42, the apparatus 40 is provided with a three-way float-controlled valve 66. The valve 66 operates between directing gas into the heating vessel 42 through the conduit 68 and venting gas to the atmosphere through the conduit 70. Operation of the valve 66 is controlled by a float 72 connected to a switch mechanism (not shown) in the valve. As the float 72 rises with the level of the water to a predetermined high point (shown in phantom lines), the valve opens to the conduit 68 to increase the pressure in the heating vessel 42 and expedite the evacuation of the water. Conversely, as the water level and the float 72 drops to a predetermined low point (shown in solid lines), the valve 66 closes to the conduit 68 and opens to the conduit 70 to release the gas to the atmosphere.

A pressure sensitive relief valve 74 preferably is included in the conduit 68 to permit gas to be vented to the atmosphere through the conduit 76 in the event of a malfunction of the three-way valve 66. The relief valve should be set at some pressure level well above that of the regulator 65. For example, with the regulator 65 set at 30 psi, the relief valve 74 may be set at about 60 psi.

It will be noted that for safety the conduit 76 and the conduit 70 may be of any length so that the point at which gas is discharged is remote from the well. This lessens any danger of inadvertent ignition due to sparks and like which may occur in the machinery associated with the well.

From time to time the gas compressor and the auxiliary engine system will be deactivated for reasons unrelated to the apparatus 10. When the compressor engine is not running, there will be no hot fluid circulating in the conduit 54 to heat the water in the heating vessel 42. Depending on the temperature of the hot exhaust and the volume of water being circulated, unheated water might not be completely vaporized in the exhaust and might collect in the conduit 28 and even back flow into the engine 24.

To prevent this complication, the evacuation of the water from the heating vessel 42 should be controlled in response to the activation and deactivation of the gas compressor 20. To this end, a pressure sensitive valve 80 is provided in the conduit 58. The valve 80 is connected in line with the conduit 54 which circulates hot fluid in the auxiliary engine system 50 around the heating vessel 42.

The valve 80 is set at about the same level as the pressure in the conduit 54. For example, a typical water pump circulates the water under a pressure of about 10 psi. Thus, where the auxiliary engine system is a water pump with this pressure, the valve 80 should be set at about 10 psi, with about a 2 psi variance. Then, when the compressor engine 24 stops and the pressure in the conduit 54 drops, the valve 80 closes preventing further emptying of the heating vessel 42.

With evacuation blocked by the closed valve 80, the water level in the heating vessel 42 rises and, in turn, triggers the three-way valve to feed gas into the vessel through the conduit 68. As the pressure rises in the heating vessel 42 it will soon equalize at about 30 psi. At this pressure the regulator 65 will close and prevent the injection of further gas into the vessel 42. The pressure in the vessel 42 will cause the check valve 48 to close, preventing entry of further water into the vessel 42. If there is some malfunction and gas continues to be fed into the vessel 42 to create a pressure above the setting of the relief valve 74, gas will be vented to the atmosphere through the conduit 76.

When the compressor engine 24 starts again, the fluid in the conduit 54 begins to circulate again and the pressure rises, the valve 80 will open and allow water to be evacuated from the vessel 42. As the pressure in the vessel 42 drops, the check valve 48 will open and permit more water from the holding tank 34 to enter the heating vessel. The lowered float 72 will trigger the valve 66 to direct gas into the vessel 42, and the cycle continues.

In accordance with the method of the present invention and now having an understanding of the apparatus previously described, water is received in the heating vessel 42. The water in the heating vessel is contacted with a hot fluid in an auxiliary engine system, such as the hot water circulating in the water pump system. This contacting is carried out under conditions which permit the heat in the hot fluid to be transferred to the water in the heating vessel 42. Preferably, a coil 56 is utilized to perform the contacting step.

The heated water then is evacuated from the heating vessel and injected into the hot exhaust from the compressor engine 24. The water may be injected into the conduit 28 or directly into the muffler 26. When the heated water is contacted with hot exhaust it is vaporized.

It will be noted that particulate matter usually is present in water collected from a gas well. This particulate matter includes calcium and salt deposits. In the operation of the present invention, the particulate matter is blown into the atmosphere with stream of steam as it is vented to the air from the muffler through the pipe 30. From here it is dispersed in the air, and no appreciable amount of particulate matter accumulates for disposal.

In the preferred practice of this method, the heating vessel 42 is pressurized by injecting gas produced by the well. The pressure facilitates evacuation of the water from the vessel 42. More preferably, the pressurization is controlled depending on the level of water in the vessel 42. Specifically, injection of gas is permitted when the water in the vessel 42 rises to a predetermined level, and injection of gas is blocked when the water in the vessel falls to a predetermined low level.

Still further, the method of this invention includes controlling the evacuation of water from the heating vessel 42 in response to deactivation of the compressor engine 24. Preferably, the control of evacuation of the vessel is tied to the operation of the water pump or other auxiliary engine system. Accordingly, a pressure sensitive valve can be employed to read the pressure in the conduit 54, to close when that pressure drops and to reopen when the pressure in the conduit rises again. In this way, no water will be cycled through the apparatus unless the auxiliary engine system is operating to heat the water in the heating vessel 42.

Now it will be appreciated that the method and apparatus of the present invention provide a system by which water at gas wells can be disposed of automatically and economically. The apparatus employs systems already in place at the well site. More particularly, the hot fluid in an auxiliary engine system heats the water, hot exhaust from the compressor engine vaporizes the water, and gas pressure from the well drives the movement of the water from the heating vessel to the hot exhaust conduit.

The apparatus of this invention is automatically turned on and off in response to the operation of the compressor, so that the system does not continue to operate unless heat is available from the auxiliary engine system. No additional energy is required to drive the apparatus.

The apparatus itself is simple and inexpensive to build and to install. The heating vessel is small enough that it can be transported easily to even the most remote well site. Moreover, because the system is fully automatic and required supervision is minimal, operation at a remote well site is practical.

Changes may be made in the combination and arrangement of the various parts, elements, steps and procedures described herein without departing from the spirit and scope of the invention as defined in the following claims.

What is claimed is:

1. A method for disposing of water produced by a gas well assembly which includes a gas compressor including an engine producing hot exhaust and an auxiliary engine system which circulates a hot fluid, the method comprising:

receiving water from the well in a heating vessel;

circulating the hot fluid in the auxiliary engine system under heat exchange conditions around the heating vessel whereby water in the heating vessel is heated;

evacuating heated water from the heating vessel; and injecting the heated water evacuated from the heating vessel into the hot exhaust from the gas compressor engine whereby the water is vaporized.

2. The method of claim 1 wherein the auxiliary engine system is a water pump.

3. The method of claim 1 wherein the auxiliary engine system is an oil pump.

4. The method of claim 1 wherein the conduit is a tube coiled around the heating vessel.

5. The method of claim 1 further comprising the step of:

pressurizing the heating vessel by injecting gas from the well into the heating vessel whereby the evacuation of water from the heating vessel is assisted.

6. The method of claim 5 further comprising the step of:

controlling the injection of gas from the well into the heating vessel in response to the level of water in the heating vessel so that injection of gas is ceased when the water level reaches a predetermined low level and injection of gas is commenced when the water level reaches a predetermined high level.

7. The method of claim 6 further comprising the step of:

controlling the evacuation of heated water from the heating vessel in response to the activation of the auxiliary engine system by terminating the evacuation when the auxiliary engine system is deactivated and activating the evacuation of water from the heating vessel when the auxiliary engine system is activated.

8. The method of claim 7 wherein the auxiliary engine system is the water pump and wherein the hot fluid from the auxiliary engine system is contacted with the water in the heating vessel by means of a conduit which coils around the heating vessel.

9. The method of claim 7 wherein the auxiliary engine system is the oil pump and wherein the hot fluid from the auxiliary engine system is contacted with the water in the heating vessel by means of a conduit which coils around the heating vessel.

10. The method of claim 1 further comprising the step of:

controlling the evacuation of heated water from the heating vessel in response to the activation of the auxiliary engine system by terminating the evacuation when the auxiliary engine system is deactivated and activating the evacuation of water from the heating vessel when the auxiliary engine system is activated.

11. An apparatus for disposing of water produced at a gas well assembly, which gas well assembly includes a gas compressor driven by an engine which produces hot exhaust vented to the atmosphere through a muffler and which includes an auxiliary engine system comprising a hot fluid in circulation, the apparatus comprising:

a heating vessel for containing water from the well under conditions whereby the water is heated;

means for circulating the hot fluid in the auxiliary engine system under heat exchange conditions around the heating vessel whereby water in the heating vessel is heated;

means for evacuating the heated water from the heating vessel; and means for injecting the heated water evacuated from the heating vessel into the hot exhaust from the gas compressor engine whereby the water is vaporized.

12. The apparatus of claim 11 wherein the auxiliary engine system is a water pump and wherein the means for circulating the hot fluid in the auxiliary engine system around the heating vessel comprises a conduit contacted with the external surface of the heating vessel.

13. The apparatus of claim 12 wherein the conduit is coiled around the heating vessel.

14. The apparatus of claim 11 wherein the auxiliary engine system is an oil pump and wherein the means for circulating the hot fluid in the auxiliary engine system around the heating vessel comprises a conduit contacted with the external surface of the heating vessel.

15. The apparatus of claim 14 wherein the conduit is coiled around the heating vessel.

16. The apparatus of claim 11 further comprising:

means for pressurizing the heating vessel by injecting gas from the well into the heating vessel whereby the evacuation of water from the heating vessel is assisted.

17. The apparatus of claim 16 further comprising:

means for controlling the injection of gas from the well into the heating vessel in response to the level of water in the heating vessel so that injection of gas is ceased when the water level reaches a predetermined low level and injection of gas is commenced when the water level reaches a predetermined high level.

18. The apparatus of claim 17 further comprising:

means for controlling the evacuation of heated water from the heating vessel in response to the activation of the auxiliary engine system by terminating the evacuation when the auxiliary engine system is deactivated and activating the evacuation of water from the heating vessel when the auxiliary engine system is activated.

19. The apparatus of claim 18 wherein the auxiliary engine system is the water pump and wherein the hot fluid from the auxiliary engine system is contacted with the water in the heating vessel by means of a conduit which coils around the heating vessel.

20. The apparatus of claim 18 wherein the auxiliary engine system is the oil pump and wherein the hot fluid from the auxiliary engine system is contacted with the water in the heating vessel by means of a conduit which coils around the heating vessel.

21. The apparatus of claim 11 further comprising:

means for controlling the evacuation of heated water from the heating vessel in response to the activation of the auxiliary engine system by terminating the evacuation when the auxiliary engine system is deactivated and activating the evacuation of water from the heating vessel when the auxiliary engine system is activated.

22. A gas well assembly comprising:

a gas well;

a separator adapted to separate water from the product of the gas well;

means for conducting the product of the gas well to the separator;

a gas compressor for compressing gas produced by the well, the compressor having an engine which produces hot exhaust and having an auxiliary engine system which circulates hot fluid;

means for conducting gas from the separator to the gas compressor;

a heating vessel for containing water from the gas well;

means for circulating the hot fluid in the auxiliary engine system under heat exchange conditions around the heating vessel whereby water in the heating vessel is heated;

means for evacuating heated water from the heating vessel; and means for injecting the heated water evacuated from the heating vessel into the hot exhaust from the gas compressor engine whereby the water is vaporized.

23. The gas well assembly of claim 22 wherein the auxiliary engine system is a water pump and wherein the means for circulating the hot fluid in the auxiliary engine system around the heating vessel comprises a conduit contacted with the external surface of the heating vessel.

24. The gas well assembly of claim 23 wherein the conduit is coiled around the heating vessel.

25. The gas well assembly of claim 22 wherein the auxiliary engine system is an oil pump and wherein the means for circulating the hot fluid in the auxiliary engine system around the heating vessel comprises a conduit contacted with the external surface of the heating vessel.

26. The gas well assembly of claim 25 wherein the conduit is coiled around the heating vessel.

27. The gas well assembly of claim 22 further comprising:

means for pressurizing the heating vessel by injecting gas from the well into the heating vessel whereby the evacuation of water from the heating vessel is assisted.

28. The gas well assembly of claim 27 further comprising:

means for controlling the injection of gas from the well into the heating vessel in response to the level of water in the heating vessel so that injection of gas is ceased when the water level reaches a predetermined low level and injection of gas is commenced when the water level reaches a predetermined high level.

29. The gas well assembly of claim 27 further comprising:

means for controlling the evacuation of heated water from the heating vessel in response to the activation of the auxiliary engine system by terminating the evacuation when the auxiliary engine system is deactivated and activating the evacuation of water from the heating vessel when the auxiliary engine system is activated.

30. The gas well assembly of claim 29 wherein the auxiliary engine system is the water pump and wherein the means for circulating the auxiliary engine system fluid around the heating vessel comprises a conduit which coils around the heating vessel.

31. The gas well assembly of claim 29 wherein the auxiliary engine system is the oil pump and wherein the means for circulating the auxiliary engine system fluid around the heating vessel comprises a conduit which coils around the heating vessel.

32. The gas well assembly of claim 22 further comprising:

means for controlling the evacuation of heated water from the heating vessel in response to the activation of the auxiliary engine system by terminating the evacuation when the auxiliary engine system is deactivated and activating the evacuation of water from the heating vessel when the auxiliary engine system is activated.

33. A method for disposing of water produced by a gas well assembly which includes a gas compressor comprising an engine which produces hot exhaust, a muffler for muffling the sound of the exhaust from the gas compressor engine, and a conduit for conducting the hot exhaust in a stream directly from the compressor engine to a muffler through which the stream of exhaust passes and is vented to the atmosphere, the method comprising:

injecting water from the gas well into the stream of hot exhaust from the gas compressor engine whereby the water is vaporized and vented to the atmosphere through the muffler with the exhaust stream.

34. The method of claim 33 wherein the method further includes:

heating the well water prior to injection step.

35. The method of claim 34 wherein the gas compressor includes an auxiliary engine system which circulates a hot fluid, and wherein the well water is heated by circulating the hot auxiliary engine system fluid under heat exchange conditions around a heating vessel containing well water, and wherein water injected into the hot exhaust stream first is evacuated from the heating vessel.

36. The method of claim 35 further comprising the step of:

pressurizing the heating vessel by injecting gas from the well into the heating vessel whereby the evacuation of water from the heating vessel is assisted.

37. The method of claim 36 further comprising the step of:

controlling the injection of gas from the well into the heating vessel in response to the level of water in the heating vessel so that injection of gas is ceased when the water level reaches a predetermined low level and injection of gas is commenced when the water level reaches a predetermined high level.

38. The method of claim 37 further comprising the step of:

controlling the evacuation of heated water from the heating vessel in response to the activation of the auxiliary engine system by terminating the evacuation when the auxiliary engine system is deactivated and activating the evacuation of water from the heating vessel when the auxiliary engine system is activated.

39. The method of claim 38 wherein the heated well water is injected into the exhaust stream as it passes through the muffler.

40. The method of claim 38 wherein the heated well water is injected into the exhaust stream before it enters the muffler.

41. The method of claim 33 wherein the well water is injected into the exhaust stream as it passes through the muffler.

42. The method of claim 33 wherein the well water is injected into the exhaust stream before it enters the muffler.

43. An apparatus for disposing of water produced at a gas well assembly, which gas well assembly includes a gas compressor driven by an engine which produces hot exhaust which is conducted in a stream directly to a muffler through which the exhaust is vented to the atmosphere, the apparatus comprising:

a water injection assembly adapted to inject water from the gas well into the stream of hot exhaust from the compressor engine whereby the water is vaporized and vented to the atmosphere through the muffler with the exhaust stream.

44. The apparatus of claim 43 further comprising:

a heating vessel adapted to receive water from the gas well and to deliver the water to the water injection assembly; and a heater assembly adapted to heat the water in the heating vessel.

45. The apparatus of claim 44 wherein the water injection assembly is defined further as injecting the water into the stream of hot exhaust before it reaches the muffler.

46. The apparatus of claim 44 wherein the water injection assembly is defined further as injecting the water into the stream of hot exhaust as it passes through the muffler.

47. The apparatus of claim 43 wherein the water injection assembly is defined further as injecting the water into the stream of hot exhaust before it reaches the muffler.

48. The apparatus of claim 43 wherein the water injection assembly is defined further as injecting the water into the stream of hot exhaust as it passes through the muffler.

49. A gas well assembly comprising:

a gas well;

a separator adapted to separate water from the product of the gas well;

means for conducting the product of the gas well to the separator;

a gas compressor for compressing gas produced by the well, the compressor having an engine which produces hot exhaust;

means for conducting gas from the separator to the gas compressor;

a muffler for muffling the sound of the exhaust from the gas compressor engine and for venting the exhaust to the atmosphere.

a conduit adapted to conduct the hot exhaust in a stream from the gas compressor engine directly to the muffler;

a water injection assembly adapted to inject water from the separator into the stream of hot exhaust from the compressor engine whereby the water is vaporized and vented to the atmosphere through the muffler with the exhaust stream.

50. The gas well assembly of claim 49 further comprising:

a heating vessel adapted to receive water from the separator and to deliver the water to the water injection assembly; and a heater assembly adapted to heat the water in the heating vessel.

51. The gas well assembly of claim 50 wherein the water injection assembly is defined further as injecting the heated water into the stream of hot exhaust before it reaches the muffler.

52. The gas well assembly of claim 50 wherein the water injection assembly is defined as injecting the heated water into the stream of hot exhaust as it passes through the muffler.

53. The gas well assembly of claim 49 wherein the water injection assembly is defined further as injecting the heated water into the stream of hot exhaust before it reaches the muffler.

54. The gas well assembly of claim 49 wherein the water injection assembly is defined further as injecting the heated water into the stream of hot exhaust as it passes through the muffler.

* * * * *

UNITED STATES PATENT AND TRADEMARK OFFICE

CERTIFICATE OF CORRECTION

PATENT NO. : 5,335,728

DATED : August 9, 1994

INVENTOR(S) : Strahan

It is certified that error appears in the above-indentified patent and that said Letters Patent is hereby corrected as shown below:

Cover page, item [76] inventor's address should read as follows:
-- 14001 Plymouth Crossing, Edmond, Oklahoma 73034 --.

Column 3, line 52, the number "28" should be --26--.

Column 10, line 68, the period at the end of the sentence should be changed to --;--.

The title page, showing the illustrative figure, should be deleted to appear as per the attached title page.

The drawing sheet, should be deleted to be replaced with the attached drawing sheet.

Signed and Sealed this

Tenth Day of January, 1995

*Attest:*

*Attesting Officer*

BRUCE LEHMAN

*Commissioner of Patents and Trademarks*

US005335728A

United States Patent [19]

Strahan

[11] Patent Number: 5,335,728

[45] Date of Patent: Aug. 9, 1994

[54] METHOD AND APPARATUS FOR DISPOSING OF WATER AT GAS WELLS

[76] Inventor: Ronald L. Strahan, 2416 Apple Way, Edmond, Okla. 73013

[21] Appl. No.: 923,699

[22] Filed: Jul. 31, 1992

[51] Int. Cl.[5] ..... E21B 43/34; E21B 36/00

[52] U.S. Cl. ..... 166/267; 166/53; 166/57; 166/302

[58] Field of Search ..... 166/267, 302, 369, 53, 166/57, 62

[56] References Cited

U.S. PATENT DOCUMENTS

| | | | |
|---|---|---|---|
| 2,497,868 | 2/1950 | Dalin . | |
| 2,588,296 | 3/1952 | Russell, Jr. . | |
| 3,057,758 | 10/1962 | Walker et al. . | |
| 3,237,689 | 3/1966 | Justheim . | |
| 3,493,050 | 2/1970 | Kelley et al. | 166/267 |
| 3,598,182 | 8/1971 | Justheim | 166/247 |
| 3,780,805 | 12/1973 | Green | 166/267 X |
| 3,989,415 | 11/1976 | Van-Hee et al. | 417/312 |
| 4,025,235 | 5/1977 | Newbrough | 417/54 |
| 4,087,208 | 5/1978 | Uda et al. | 417/54 |
| 4,159,036 | 6/1979 | Wilson et al. | 166/267 |
| 4,349,228 | 9/1982 | Rohde | 299/10 |
| 4,366,063 | 12/1982 | O'Connor | 210/652 |
| 4,395,338 | 7/1983 | Rowton | 210/747 |
| 4,442,898 | 4/1984 | Wyatt | 166/303 |
| 4,463,803 | 8/1984 | Wyatt | 166/59 |
| 4,509,599 | 4/1985 | Chenoweth et al. | 166/370 |
| 4,531,584 | 7/1985 | Ward | 166/265 |
| 4,536,293 | 8/1985 | Babineaux, III | 210/717 |
| 4,573,911 | 3/1986 | Kimmich | 166/302 X |
| 4,597,437 | 7/1986 | McNabb | 166/79 |
| 4,613,338 | 9/1986 | Rogers et al. | 23/301 |
| 4,661,127 | 4/1987 | Huntley | 55/174 |
| 4,779,677 | 10/1988 | Cobb | 166/79 |
| 4,804,477 | 2/1989 | Allen et al. | 210/737 |
| 4,882,009 | 11/1989 | Santoleri et al. | 159/4.2 |
| 4,930,574 | 6/1990 | Jäger et al. | 166/266 |
| 4,995,460 | 2/1991 | Strahan | 166/267 |
| 5,002,657 | 3/1991 | Botts | 210/115 |

FOREIGN PATENT DOCUMENTS 985640 3/1965 United Kingdom .

*Primary Examiner*—George A. Suchfield
*Attorney, Agent, or Firm*—Dunlap, Codding & Lee

[57] ABSTRACT

A method and apparatus for disposing of water at gas wells. Water from the water holding tank is collected periodically in a heating vessel. Hot fluid from an auxiliary engine system, such as the oil pump or the water pump for the compressor engine, is pumped through a heat conductive coil around the heating vessel to heat the well water in the heating vessel. The heated well water then is injected into the hot exhaust line from the compressor either between the compressor and the muffler or alternatively is injected directly into the muffler. The heating vessel is pressurized with gas from the well to assist in the evacuation of the heated water from the heating vessel and the injection of the well water into the hot exhaust. A system of valves controls the delivery of water to the heating vessel, ensures that the heating vessel will not be over pressurized and deactivates the apparatus when the gas compressor is not running.

54 Claims, 1 Drawing Sheet

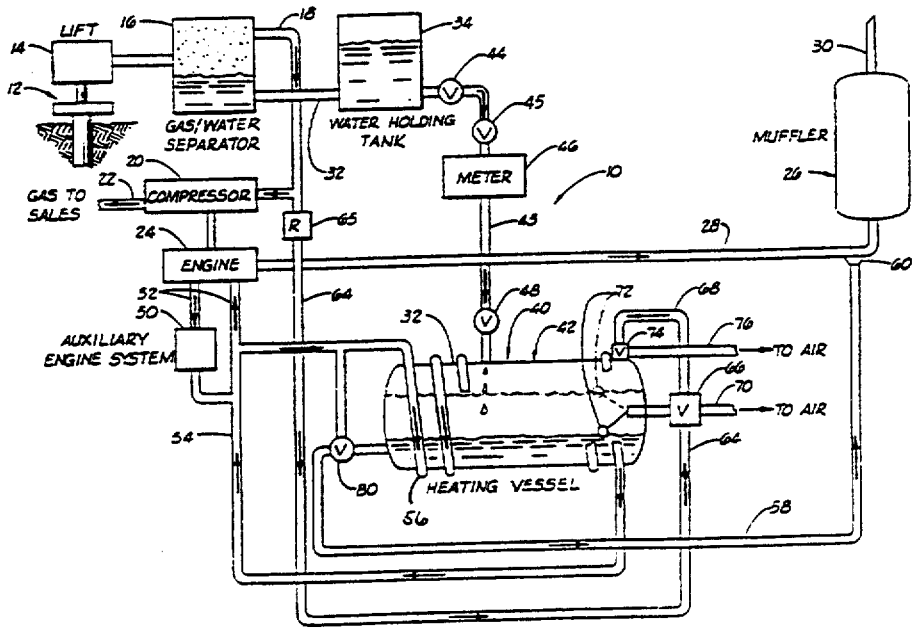

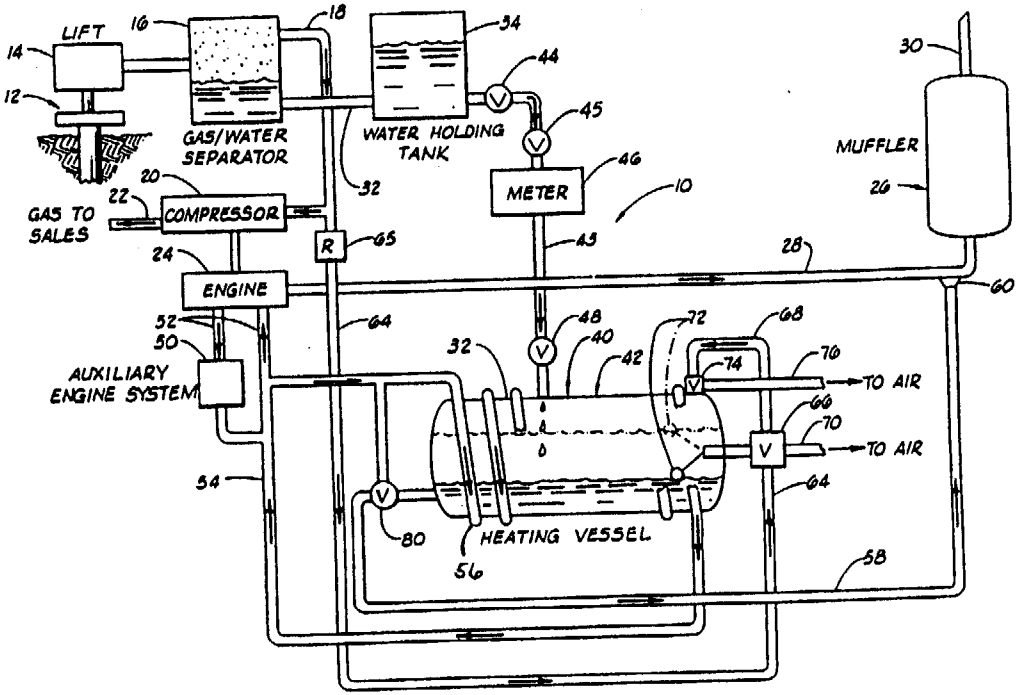
MUFFLER
METER
WATER HOLDING TANK
GAS/WATER SEPARATOR
COMPRESSOR
ENGINE
LIFT
GAS TO SALES
AUXILIARY ENGINE SYSTEM
HEATING VESSEL
TO AIR
TO AIR
R